US007147040B2

(12) United States Patent
Calhoun et al.

(10) Patent No.: US 7,147,040 B2
(45) Date of Patent: Dec. 12, 2006

(54) HEAT EXCHANGER WITH TANK UTILIZING INTEGRAL POSITIONING GUIDES

(75) Inventors: Chris A. Calhoun, Niagara Falls, NY (US); Terry Joseph Hunt, Williamsville, NY (US); David A. Southwick, Lockport, NY (US); Karl Paul Kroetsch, Williamsville, NY (US); Krzysztof Wawrocki, Ostrow Wlkp. (PL); Khalid El Moutamid, Vivier au Court (FR); Yusuke Matsunaga, Amherst, NY (US); Laurent Art, Ethe (BE)

(73) Assignee: Delphi Technologies, Inc., Troy, MI (US)

( * ) Notice: Subject to any disclaimer, the term of this patent is extended or adjusted under 35 U.S.C. 154(b) by 402 days.

(21) Appl. No.: 10/754,031

(22) Filed: Jan. 8, 2004

(65) Prior Publication Data

US 2005/0150646 A1 Jul. 14, 2005

(51) Int. Cl.
*F28D 1/03* (2006.01)

(52) U.S. Cl. ..... 165/78; 165/140; 165/916

(58) Field of Classification Search ..... 165/76, 165/78, 140, 916
See application file for complete search history.

(56) References Cited

U.S. PATENT DOCUMENTS

| | | | | |
|---|---|---|---|---|
| 4,553,586 A | | 11/1985 | Lardner | 165/76 |
| 5,113,930 A | * | 5/1992 | le Gauyer | 165/78 |
| 5,937,938 A | * | 8/1999 | Makino et al. | 165/140 |
| 6,988,541 B1 | * | 1/2006 | Nakajima et al. | 165/140 |

FOREIGN PATENT DOCUMENTS

| | | | |
|---|---|---|---|
| JP | 08177493 A | * | 7/1996 |
| JP | 11142074 A | | 5/1999 |
| JP | 11248393 A | | 9/1999 |
| JP | 2001153586 A | * | 6/2001 |
| JP | 2001165589 A | * | 6/2001 |

* cited by examiner

*Primary Examiner*—Allen J. Flanigan
(74) *Attorney, Agent, or Firm*—Patrick M. Griffin

(57) ABSTRACT

A heat exchanger is disclosed. A plurality of guides are integrally formed with the walls of a header tank and are used to position an oil cooler inside the tank to align a pair of fittings carried by the cooler with a pair of spaced openings in the tank.

9 Claims, 5 Drawing Sheets

HEAT EXCHANGER WITH TANK UTILIZING INTEGRAL POSITIONING GUIDES

BACKGROUND OF THE INVENTION

1. Field of the Invention

The subject invention relates to a heat exchanger intended for use in a motor vehicle radiator and which utilizes a one piece aluminum tank within which a transmission oil cooler is positioned.

2. Description of the Related Art

Various heat exchangers exist in the art to control the temperature of oil as the oil circulates within the transmission of a motor vehicle. Such devices typically include a header tank connected to a radiator core. A transmission oil cooler is an auxiliary heat exchanger that is typically positioned within a chamber located within the header tank. Placing the oil cooler inside the chamber allows coolant to pass from core into the chamber and over the exterior of the oil cooler, which in turn decreases the temperature of oil as it passes through the oil cooler before the oil is cycled back through the transmission.

Aluminum heat exchangers typically consist of one or more manifolds, or tanks, formed from glass reinforced nylon plastic. Such tanks are connected to a core subassembly formed from aluminum. The plastic tanks are connected to the aluminum core subassembly by gasket seals, which are applied using a mechanical crimping operation. One of the tanks contains the transmission oil cooler, which is usually fastened to an interior sidewall of the tank using conventional nuts and gasket seals.

In those radiators utilizing aluminum cores and heat exchangers which include plastic tanks, installing transmission oil coolers using conventional tools is not a problem because the interior volume of the tanks is large enough to comfortably receive the tooling required to position the oil cooler inside the tank before the nuts and seals are installed and tightened. However, in those radiators utilizing cores and tanks formed entirely from aluminum, the smaller tank area and other advantages gained by eliminating the area that would have otherwise been occupied by the crimped gasket seals are often overcome by the disadvantage of having less space within the interior of the tank for inserting conventional tooling to properly position the oil cooler before the cooler is secured into a final position.

Heat exchangers exist that incorporate specialized components to assist with properly positioning an oil cooler within a tank. However, rather than simplifying matters, the specialized components further complicate the multi-step process of installing the cooler within the tank. One such device, the invention disclosed in U.S. Pat. No. 4,553,586 ("Lardner"), utilizes H-shaped retaining members to restrain an oil cooler against movement within a tank. However, the retaining members must be separately installed after the oil cooler has been positioned in the tank. This renders the retaining members unsuitable for use in space-compromised, one piece aluminum tanks.

Although certain references specifically disclose one piece tanks incorporating oil coolers, see e.g., Japanese Publication Nos. 11248393 A and 11142074 A, the inventions disclosed therein fail to provide any type of simplified positioning guides or retainers formed in a one piece tank to aid in positioning an oil cooler therein. Thus, there remains an opportunity for a heat exchanger to be provided that utilizes a one-piece tank featuring integrally formed guides that permit an oil cooler to be positioned for final assembly within the tank without requiring the use of extraneous tools.

BRIEF SUMMARY OF THE INVENTION AND ADVANTAGES

The subject invention provides a heat exchanger. The heat exchanger includes an oil cooler positioned in a tank. The oil cooler has outer sidewalls upon which a pair of spaced fittings are carried. The tank includes walls that extend parallel to one another to define a chamber and at least one open end for receiving the oil cooler. One of the walls also defines a pair of spaced openings. A plurality of spaced guides are carried by the tank in the chamber for positioning the oil cooler in the tank. Each of the guides are integrally formed with the walls of the tank for guiding the oil cooler to pass through the open end and into the chamber. The guides also align the fittings with the openings and hold the fittings into engagement with the first wall about the openings.

Accordingly, the subject invention overcomes the limitations of the related art by providing a heat exchanger featuring a tank specifically designed to receive an oil cooler without requiring that the cooler be manipulated into position by forcing tools or additional loose parts into the already cramped interior of the tank. This is achieved by incorporating integrally-formed guides into the interior walls of the tank. Each guide is specifically designed to engage a complementary surface of the oil cooler, which ensures that the cooler is precisely positioned inside the tank, thereby eliminating the need for separate tools or other components.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
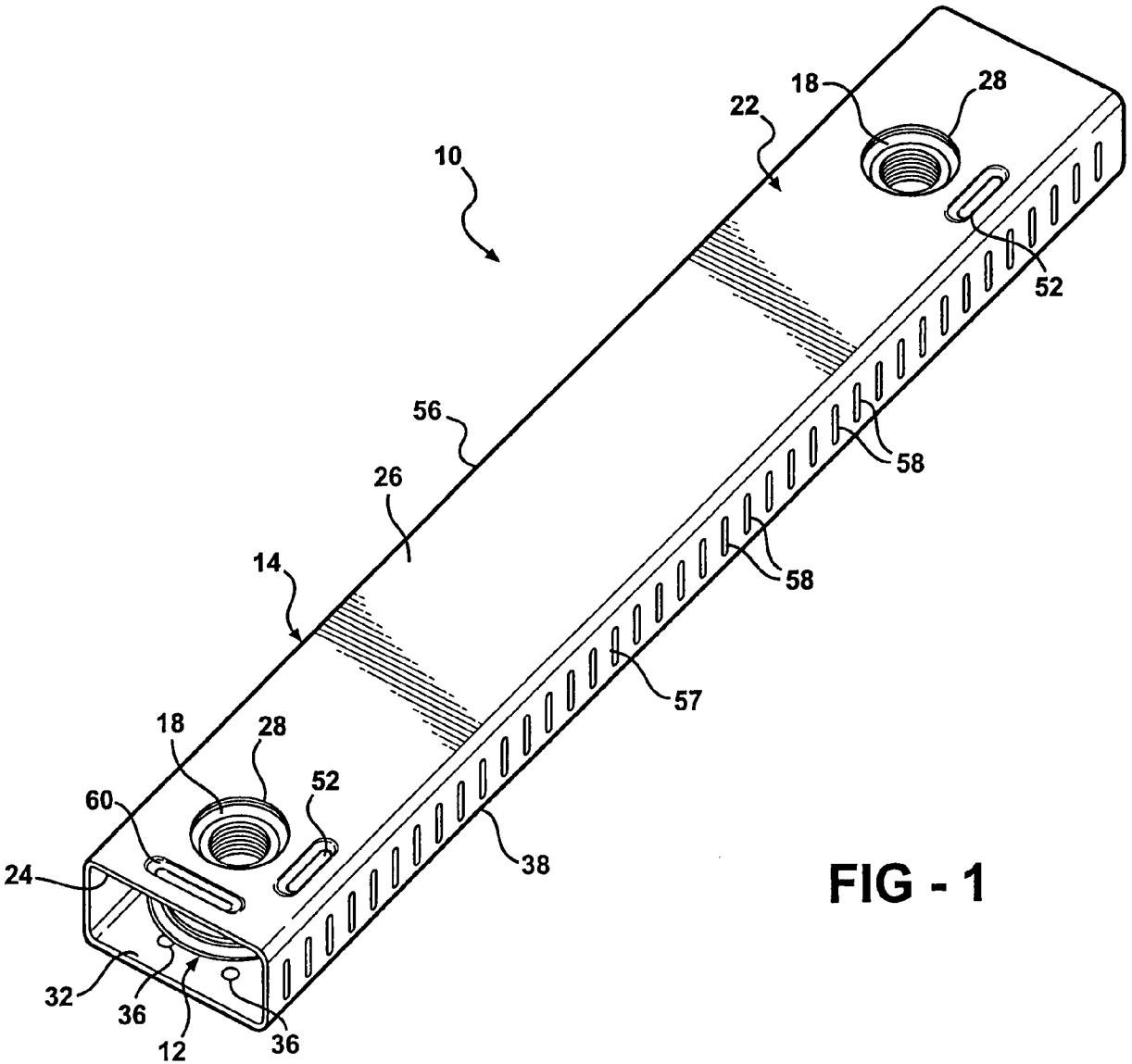
FIG. 1 is a perspective view of a heat exchanger according to the subject invention.
Figure 2:
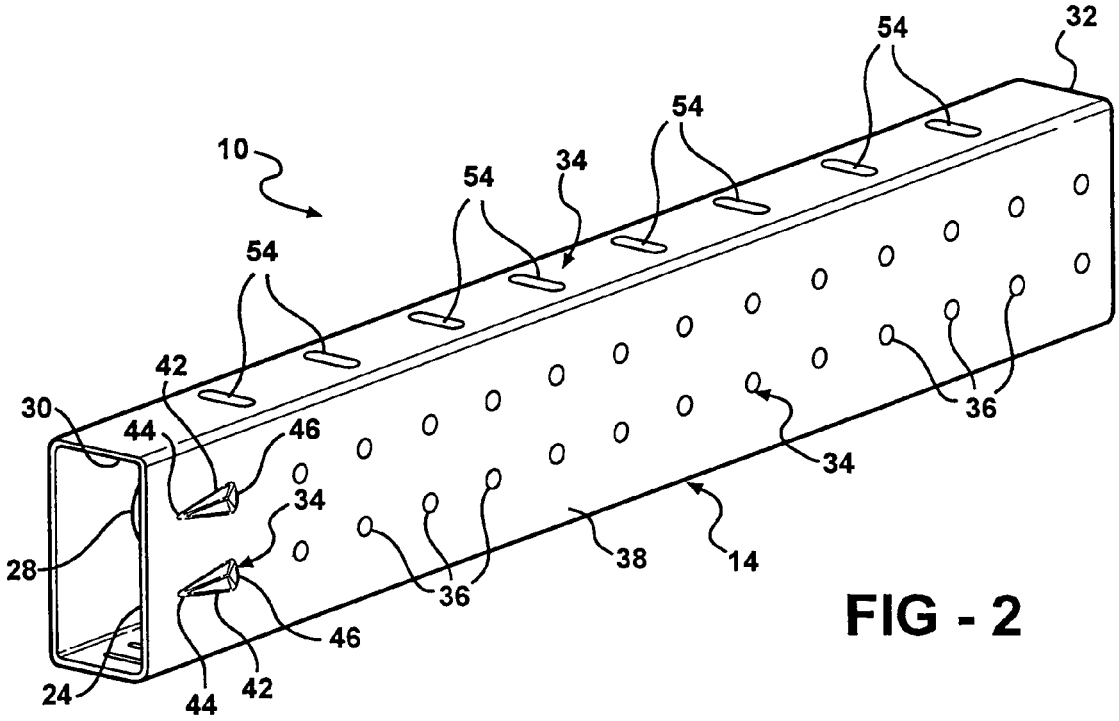
FIG. 2 is another perspective view of the heat exchanger shown in FIG. 1.
Figure 3:
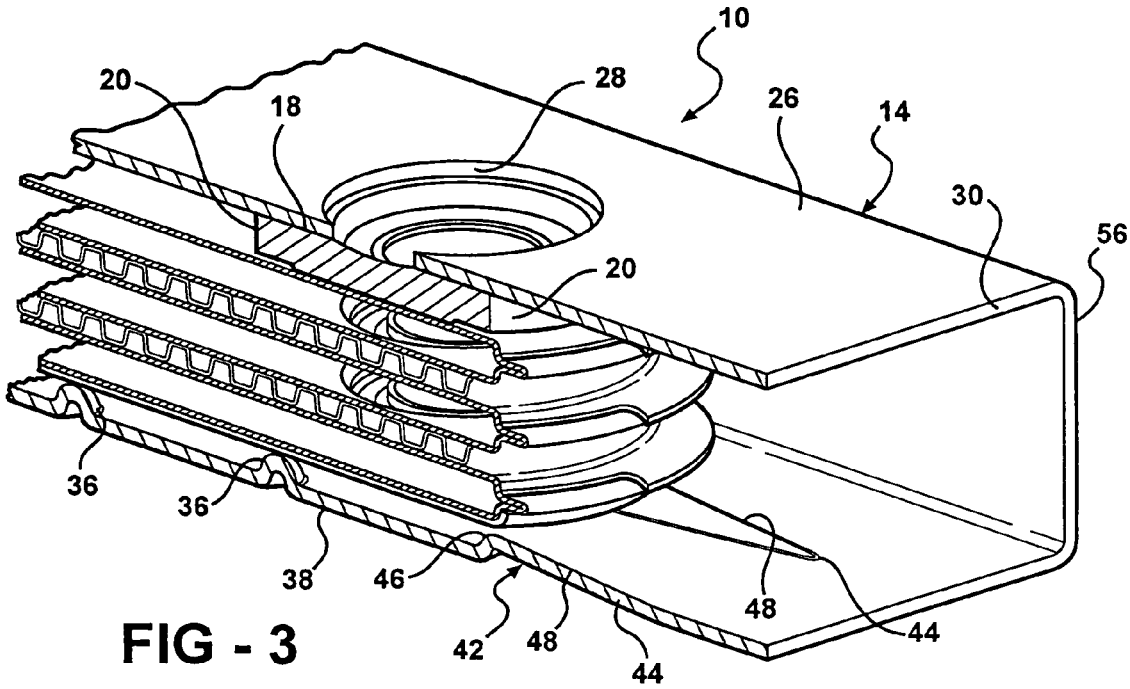
FIG. 3 is a fragmentary, cross-sectional view of one end of the heat exchanger taken from line 3—3 of FIG. 1.
Figure 4:
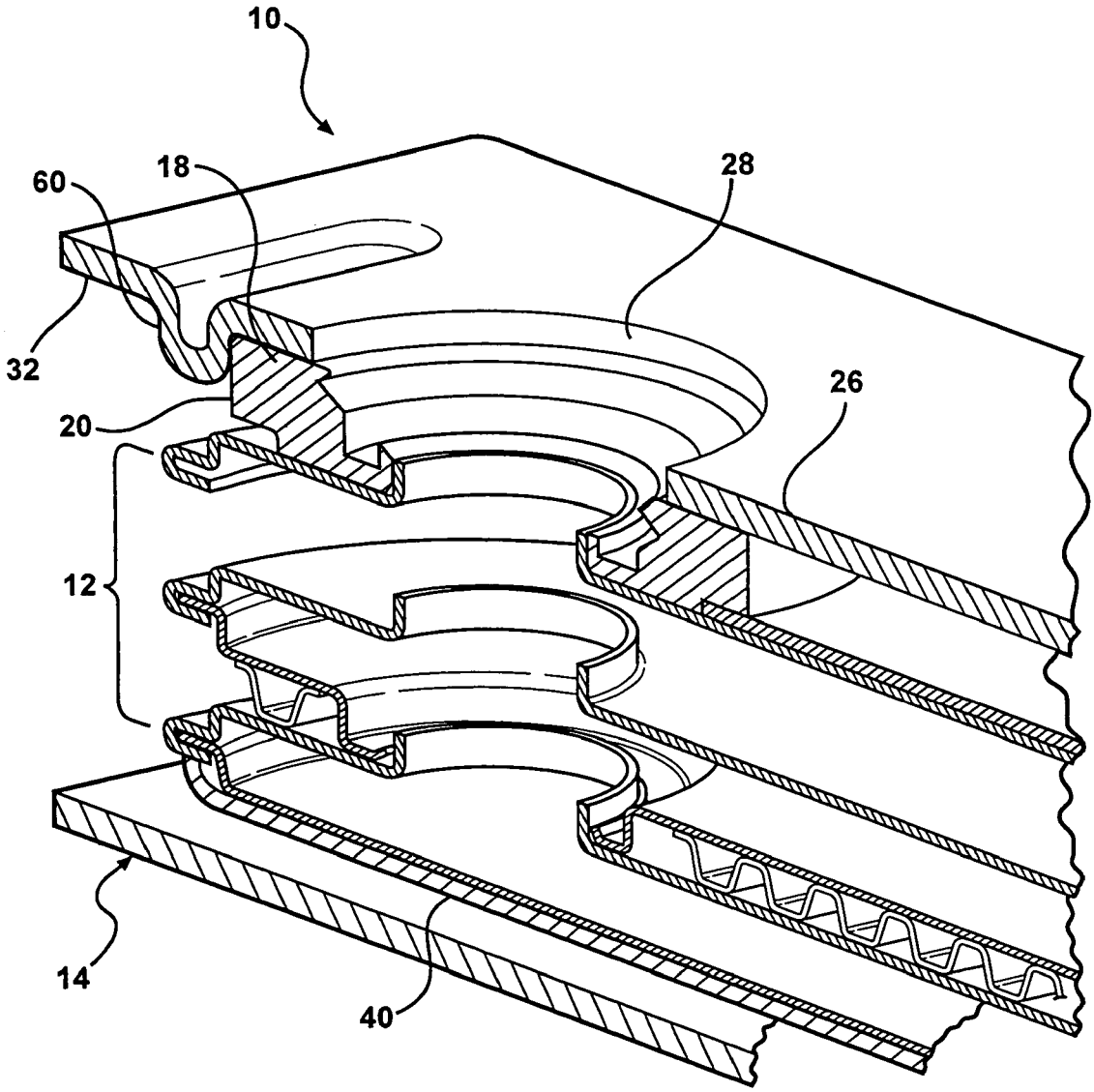
FIG. 4 is a fragmentary, cross-sectional view of the opposite end of the heat exchanger taken from line 3—3 of FIG. 1.
Figure 5:
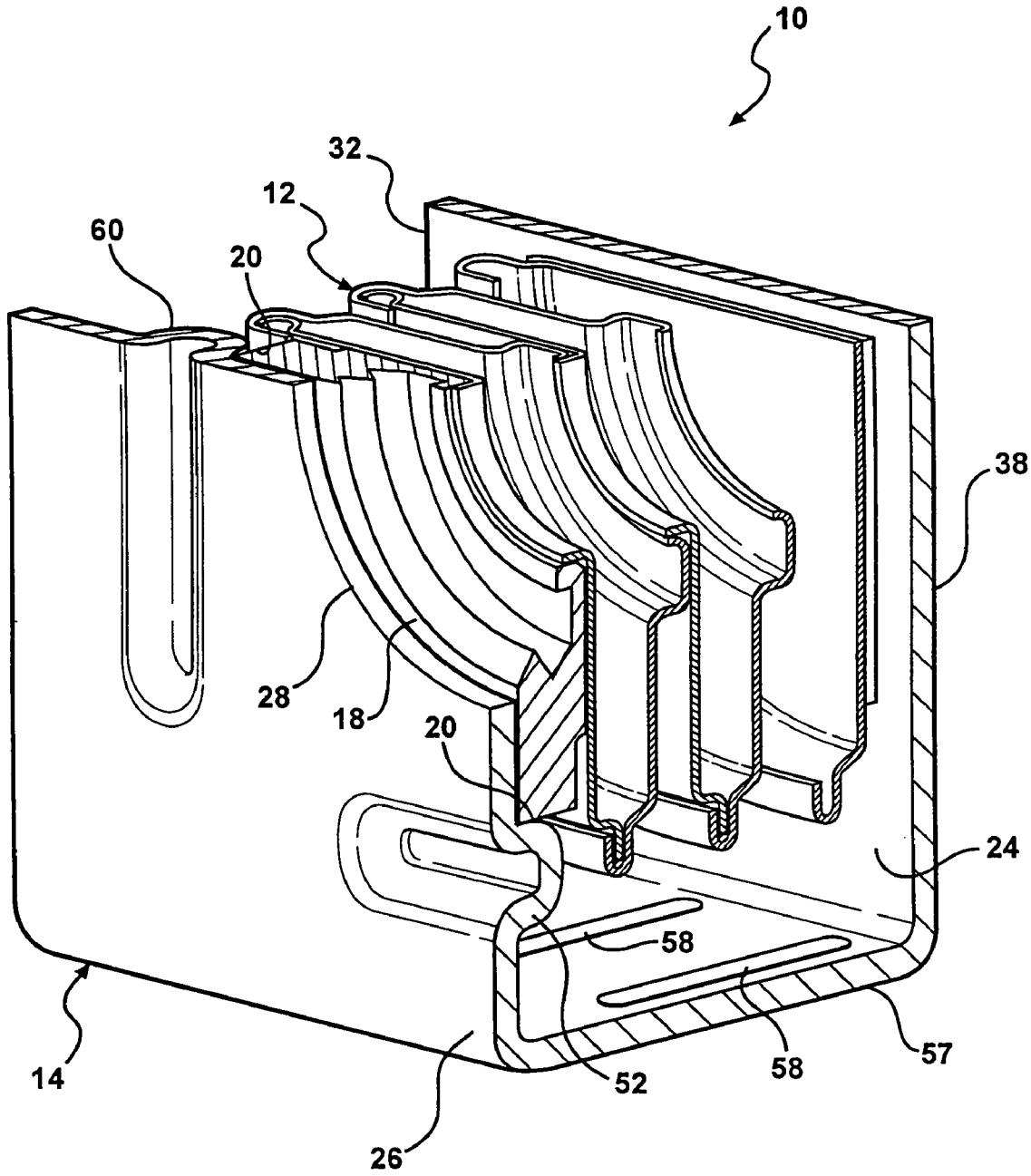
FIG. 5 is a fragmentary, cross-sectional view of the heat exchanger taken from lines 3—3 and 5—5 of FIG. 1.
Figure 6:
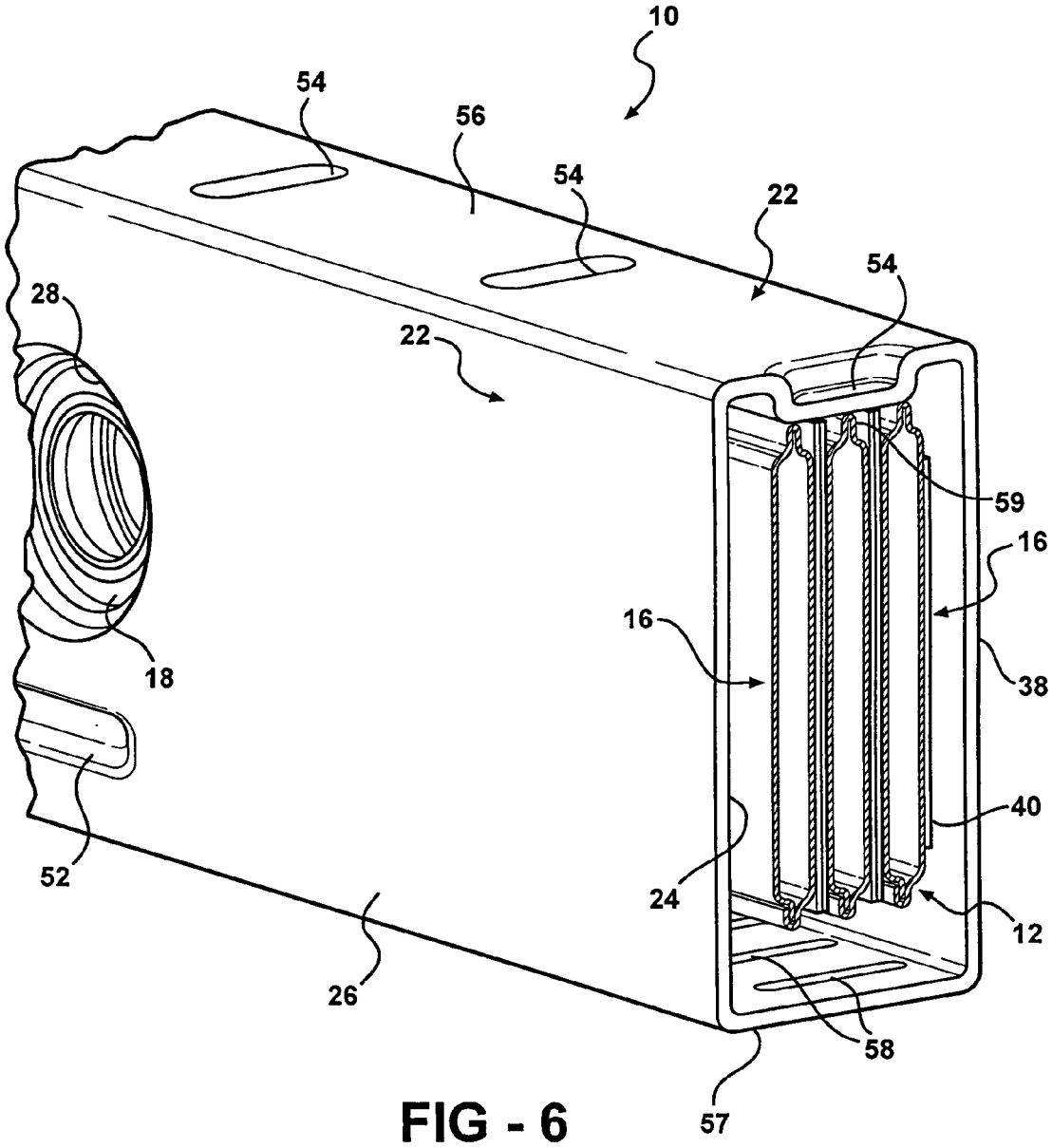
FIG. 6 is a fragmentary view of the heat exchanger showing the first open end and chamber of the tank with the oil cooler positioned therein.

Referring to the Figures, wherein like numerals indicate like or corresponding parts throughout the several views, a heat exchanger is shown generally at 10 in FIG. 1. The heat exchanger 10 includes an oil cooler 12 and a tank 14. The oil cooler 12 has outer sidewalls 16 that carry a pair of spaced fittings 18. Each of the fittings 18 includes a peripheral edge 20. Although the tank 14 may be formed from any suitable materials and be formed in any suitable shape, the tank 14 is formed from aluminum and includes walls 22 that extend parallel to one another to define a chamber 24. A first wall 26 of the walls 22 defines a pair of spaced openings 28. The walls 22 also define at least one open end 30 for receiving the oil cooler 12. Specifically, the walls 22 define opposed open ends 30 and 32, respectively. The chamber 24 extends between the open ends 30 and 32, and receives the oil cooler 12.

The heat exchanger 10 also includes a plurality of spaced guides 34. The guides 34 are carried by the tank 14 in the chamber 24, and are used for positioning the oil cooler 12 in the tank 14. Each of the guides 34 is integrally formed with the walls 22 for guiding the oil cooler 12 to pass through the open end 30. Once through the open end 30, the oil cooler 12 passes into the chamber 24, where the guides 34 align the fittings 18 with the openings 28 and hold the fittings 18 into engagement with the first wall 26 about the openings 28.

The guides 34 include a plurality of spaced detents 36. The detents 36 extend from a second wall 38 of the walls 22 toward the openings 28. The detents 36 cooperate with one another for engaging a first outer sidewall 40 of the outer sidewalls 16 of the oil cooler 12.

The guides 34 also include at least one ramp 42. In particular, a pair of spaced ramps 42 are positioned on the second wall 38 between the open end 30 and the detents 36 for receiving the oil cooler 12 and guiding the oil cooler 12 onto the detents 36. The ramps 42 extend parallel to the longitudinal axis of the tank 14. Each ramp 42 has a low end 44 positioned adjacent the open end 30 and a high end 46 positioned adjacent the detents 36. An inclined surface 48 extends between the low and high ends 44 and 46. The first outer sidewall 40 is received on the inclined surfaces 48 of the ramps 42, which permits sliding movement of the oil cooler 12 from the low ends 44 to the high ends 46 and onto the detents 36.

The guides 34 also include a pair of primary ridges 52. The primary ridges 52 extend from the first wall 26 into the chamber 24 parallel to the longitudinal axis of the tank 14. Each of the primary ridges 52 is positioned adjacent a selected one of the openings 28. Positioning the primary ridges 52 in this manner permits each primary ridge 52 to engage the peripheral edge 20 of a selected one of the fittings 18, which maintains the fitting 18 in alignment with the opening 28.

The guides 34 also include a plurality of secondary ridges 54. Unlike the primary ridges 52, the secondary ridges 54 extend perpendicularly to the longitudinal axis of the tank 14 from a third wall 56 of the walls 22 and toward the openings 28. A fourth wall 57 of the walls 22 defines a plurality of spaced slots 58. The slots 58 permit fluid flow into the chamber 24.

The secondary ridges 54 receive the oil cooler 12. In particular, a second outer sidewall 59 of the oil cooler 12 is received on the secondary ridges 54. The secondary ridges 54 cooperate with the pair of primary ridges 52 to maintain the fittings 18 in alignment with the openings 28.

The guides 34 also feature an end stop 60. The end stop 60 is positioned on the first wall 26 opposite the open end 30 adjacent one of the openings 28. Also located adjacent the open end 32, the end stop 60 is positioned for abutting engagement with the oil cooler 12 to prevent continued translation of the oil cooler 12 through the chamber 24. The end stop 60 achieves this by extending perpendicularly to the longitudinal axis of the tank 14 between the third and fourth walls 56 and 57, which permits the end stop 60 to engage the peripheral edge 20 of a selected one of the fittings 18, which in turn prevents the oil cooler from translating through the second open end 32. The end stop 60 also cooperates with the pair of primary ridges 52, the secondary ridges 54 and the detents 36 to maintain the oil cooler 12 in a stationary position within the chamber 24 for urging the fittings 18 into engagement with the first wall 26 about the openings 28.

As is customary in the art, once the oil cooler 12 is positioned within the chamber 24, end caps are used to close the ends 30 and 32 of the tanks using conventional brazing techniques.

Obviously, many modifications and variations of the present invention are possible in light of the above teachings. The invention may be practiced otherwise than as specifically described within the scope of the appended claims. The foregoing description of the invention is provided for the purpose of illustration only and not for the purpose of limitation—the invention being defined by the claims.

What is claimed is:

1. A heat exchanger comprising;

an oil cooler including outer sidewalls and a pair of spaced fittings carried by said outer sidewalls, a tank including walls extending parallel to one another to define a chamber and at least one open end for receiving said oil cooler, a first of said walls defining a pair of spaced openings, and a plurality of spaced guides carried by said tank in said chamber for positioning said oil cooler in said tank, each of said guides integrally formed with said walls for guiding said oil cooler to pass through said open end and into said chamber and for aligning said fittings with said openings and for holding said fittings into engagement with said first wall about said openings; wherein said guides include a plurality of spaced detents extending from a second of said walls toward said openings for engaging a first of said outer sidewalls of said oil cooler.

2. A heat exchanger according to claim 1 wherein said guides include at least one ramp positioned on said second wall between said open end and said detents for receiving said oil cooler thereon and guiding said oil cooler onto said detents.

3. A heat exchanger according to claim 2 wherein said ramp includes a low end positioned adjacent said open end, a high end positioned adjacent said detents, and an inclined surface extending between said low and high ends and for receiving said first outer sidewall and for permitting sliding movement of said oil cooler from said low end to said high end and onto said detents.

4. A heat exchanger according to claim 1 wherein each of said fittings includes a peripheral edge and said guides include a pair of primary ridges extending parallel to the longitudinal axis of said tank, each of said primary ridges positioned adjacent a selected one of said openings and extending from said first wall into said chamber for engaging said peripheral edge of a selected one of said fittings to maintain said fitting in alignment with said opening.

5. A heat exchanger according to claim 4 wherein said guides include a plurality of secondary ridges extending perpendicularly to the longitudinal axis of said tank from a third one of said walls toward said openings for receiving said oil cooler thereon and cooperating with said pair of primary ridges to maintain said fittings in alignment with said openings.

6. A heat exchanger according to claim 1 wherein said guides include an end stop positioned on said first wall adjacent one of said openings opposite said open end for abutting engagement with said oil cooler to thereby prevent continued translation of said oil cooler through said chamber.

7. A heat exchanger according to claim 6 wherein each of said fittings includes a peripheral side edge and said end stop extends perpendicularly to the longitudinal axis of said tank between third and fourth ones of said walls for abutting engagement with said peripheral edge of a selected one of said fittings.

8. A heat exchanger according to claim 1 wherein one of said walls defines a plurality of spaced slots for permitting fluid flow into said chamber.

9. A heat exchanger comprising;

an oil cooler including first and second opposed outer sidewalls and a pair of spaced fittings carried by said first outer sidewall and extending away from said second outer sidewall, a tank including walls extending parallel to one another to define first and second open ends and a chamber extending therebetween for receiving said oil cooler, a first of said walls defining a pair of spaced openings, a plurality of spaced detents integrally formed with a second of said walls and extending toward said openings for engaging said first outer sidewall of said oil cooler, a third one of said walls defining a plurality of spaced slots extending therethrough for permitting fluid flow into said chamber, a pair of spaced ramps integrally formed with said second wall between said first open end and said detents, each of said ramps extending parallel to the longitudinal axis of said tank and including a low end positioned adjacent said first open end, a high end positioned adjacent said detents, and an inclined surface extending between said low and high ends and for receiving said second outer sidewall to permit sliding movement of said oil cooler from said low end to said high end and onto said detents, a pair of primary ridges integrally formed with and extending from said first wall into said chamber parallel to the longitudinal axis of said tank, each of said primary ridges positioned adjacent a selected one of said openings for engaging a selected one of said fittings to align said fitting with said opening, a plurality of secondary ridges integrally formed with a third one of said walls and extending perpendicularly to the longitudinal axis of said tank toward said openings for receiving said second outer sidewall of said oil cooler thereon and cooperating with said pair of primary ridges to maintain said fittings in alignment with said opening, and an end stop integrally formed with said first wall adjacent said second open end for abutting engagement with a selected one of said fittings to prevent said oil cooler from traversing through said second open end and for cooperating with said pair of primary ridges, said secondary ridges and said detents to maintain said oil cooler in a stationary position within said chamber for urging said fittings into engagement with said first wall about said openings.

* * * * *